United States Patent [19]

Horodysky et al.

[11] Patent Number: 4,545,915

[45] Date of Patent: Oct. 8, 1985

[54] LUBRICANTS CONTAINING POLYHYDROXY HYDROCARBYLAMINES

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 642,924

[22] Filed: Aug. 21, 1984

Related U.S. Application Data

[62] Division of Ser. No. 536,801, Sep. 28, 1983.

[51] Int. Cl.[4] ..... C10M 1/32

[52] U.S. Cl. ..... 252/515 R

[58] Field of Search ..... 252/51.5 R

[56] References Cited

U.S. PATENT DOCUMENTS

| | | | |
|---|---|---|---|
| 2,903,427 | 9/1959 | Bidault et al. | 252/51.5 R X |
| 3,456,013 | 7/1969 | Egan et al. | 252/51.5 R X |
| 3,929,655 | 12/1975 | Gattuso | 252/51.5 R |
| 4,231,883 | 11/1980 | Malec | 252/51.5 R X |
| 4,382,006 | 5/1983 | Horodysky | 252/51.5 R X |

*Primary Examiner*—William R. Dixon, Jr.
*Assistant Examiner*—Cynthia A. Prezlock
*Attorney, Agent, or Firm*—Alexander J. McKillop; Michael G. Gilman; Van D. Harrison, Jr.

[57] ABSTRACT

Polyhydroxy-containing hydrocarbylamines, when added to a lubricant or to a liquid fuel, reduce friction between surfaces of metal in contact. They also can reduce fuel consumption in an internal combustion engine.

17 Claims, No Drawings

LUBRICANTS CONTAINING POLYHYDROXY HYDROCARBYLAMINES

This is a divisional of copending application Ser. No. 536,801, filed on Sept. 28, 1983.

BACKGROUND OF THE INVENTION

1. Field of the Invention

The invention relates to lubricant and liquid fuel compositions. In particular, it relates to the use of polyhydroxy-containing hydrocarbylamines in lubricants and liquid fuels to reduce friction and fuel consumption in internal combustion engines.

2. Discussion of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of especial significance in an internal combustion engine and related power train components, because loss of a substantial amount of the theoretical mileage possible from a gallon of fuel is traceable directly to friction.

With respect to the compositions of this invention, no art is known that teaches or suggests them. However, certain amines are well known for their use in lubricants. For example, N-phenyl-alphanaphthylamine has been used alone and in combination with other materials as an antioxidant.

SUMMARY OF THE INVENTION

In accordance with the present invention there is provided a lubricant or liquid fuel composition comprising a major portion of a fuel or lubricant and a friction reducing amount of a polyhydroxyl hydrocarbylamine containing a total of 12 to 66 carbon atoms. In such compositions, the product can be used in friction reducing amounts, which can range from about 0.1% by weight to about 2.0% by weight in lubricants. "Hydrocarbyl" includes alkyl or alkenyl.

BACKGROUND OF THE INVENTION

The polyhydroxy hydrocarbylamines contemplated for use in this invention are those having the formula:

$$(HO)_xRN(R^1)_2$$

wherein R is a $C_2$ to $C_6$ hydrocarbyl, $R^1$ is hydrogen or a $C_{10}$ to $C_{30}$ hydrocarbyl group, at least one of which is the latter, and x is 2 or 3. R and $R^1$ may be linear or branched, saturated or unsaturated. The hydroxyl groups may be located anywhere along the chain, i.e., they may be separated by any number of carbons in the chain or they may be on adjacent carbons. Although the location of the hydroxy group is not critical, optimal performance is exhibited when they are vicinal and near or at the end of the chain.

Alkyl amines which can be used to prepare the polyhydroxy hydrocarbylamines include cocoamine, oleylamine, octadecylamine, soyamine, decylamine, dodecylamine, tetradecylamine, stearylamine, tallowamine, and mixtures of above or similar amines. Also included are the t-alkylamines in the $C_{12}$ to $C_{14}$ carbon range having the following grouping

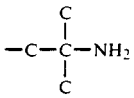

as exemplified by the commercially available Primene 81R from Rohm and Hass. Further contemplated are the higher molecular weight Primene JM-T. Preferred, however, are linear or only slightly branched amines.

As disclosed hereinabove, the polyhydroxyamines are used in lubricating oils to the extent of from about 0.1% to about 2% by weight of the total composition and in fuels in an amount of from about 0.0001% by weight to about 0.2% by weight. Furthermore, other additives, such as detergents, antioxidants, antiwear agents and the like may be present. These include phenates, sulfonates, succinimides, zinc dithiophosphates, polymers and the like.

The amines of the invention are especially effective in synthetic oils formulated using mixtures of synthetic hydrocarbon olefin oligomers and lesser amounts of hydrocarbyl carboxylate ester fluids.

In general, the lubricants contemplated for use with the esters herein disclosed include mineral and synthetic hydrocarbon oils of lubricating viscosity, mixtures of mineral oils and synthetic oils and greases from any of these. The synthetic hydrocarbon oils include long chain alkanes such as cetanes and olefin polymers such as oligomers of hexane, octene, decene, and dodecene, etc. The other synthetic oils, which can be used alone with the compounds of this invention, or which can be mixed with a mineral and synthetic hydrocarbon oil, or mixtures thereof, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

The liquid fuels contemplated include liquid hydrocarbon fuels such as fuel oils, diesel oils and gasolines and alcohol fuels such as methanol and ethanol.

Having described the invention in general terms, the following are offered to specifically illustrate the development. It is to be understood they are illustrations only and that the invention shall not be limited except by the appended claims.

EXAMPLE 1

1,2-Dihydroxypropane Cocoamine

Approximately 1050 g of cocoamine and about 1.3 liters of toluene were charged to a 5 liter glass reactor. Over a 3 hour period, 370 g of glycidol were slowly added in small increments with agitation. The reaction was exothermic, reaching 90° C. at the end of the glycidol addition. The reactor contents were then heated at 105° C. for about 4½ additional hours. The solvent was removed by vacuum distillation leaving an amber fluid product which formed a white waxy solid upon cooling.

EXAMPLE 2

1,2-Dihydroxypropane Cocoamine

Approximately 10 g of cocoamine and 0.2 liters of toluene were charged to a glass reactor. Over a 3 hour period of time, 37 g of glycidol were slowly added in small increments with agitation. The reaction was exothermic and the reaction temperature was held within a range of 22° to 31° C. for 2 additional hours. By infrared absorption spectroscopy analysis, it was found that both $—NH_2$ and epoxide groups had disappeared and large hydroxyl adsorption bands appeared. The solvent was removed by vacuum distillation. The product formed a white, waxy solid upon cooling.

EXAMPLE 3

1,2-Dihydroxypropane Octadecylamine

Approximately 280 g of octadecylamine and about 0.35 liter of toluene were charged to a glass reactor and warmed to about 60° C. Over a 3 hour period of time, 38 g of glycidol were slowly added in small increments with agitation while maintaining a temperature of 60° to 65° C. The reactor contents were then heated at about 90° C. for 26 additional hours. The solvent was removed by vacuum distillation and the resulting product formed a pale yellow waxy solid after cooling.

EVALUATION OF PRODUCTS

The compounds were evaluated as friction modifiers in accordance with the following test.

LOW VELOCITY FRICTION APPARATUS

Description

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12—12 ml of test lubricant are placed on the LVFA. A 240 psi load is applied and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The friction-reducing ester additives were evaluated in a fully formulated SAE 5W-30 lubricating oil. comprising an additive package including antioxidant, detergent and dispersant. The oil had the following general characteristics:

Viscosity 100° C.—11.0cs
Viscosity 40° C.—58.2cs
Viscosity Index—172

TABLE 1

| | Frictional Properties | | |
|---|---|---|---|
| | Additive | Reduction of % Change in Coefficient of Friction | |
| | Conc. Wt. % | 5 Ft./Min. | 30 Ft./Min. |
| Base Oil | — | 0 | 0 |
| Example 1 | 1 | 31 | 37 |
| Example 2 | ½ | 21 | 22 |
| Example 3 | ½ | 27 | 31 |

The results clearly show the hydrocarbyl polyhydroxyamine to be a superior friction reducer. The use of ½% of the products of Examples 1 and 2 reduced the coefficient of friction by up to 31%.

We claim:

1. A lubricant composition comprising a major amount of a lubricant selected from the group consisting of (1) a mineral oil, (2) a synthetic oil, (3) a mixture of synthetic oils, (4) a mixture of a mineral oil and a synthetic oil and (5) a grease of (1), (2), (3) or (4) and an antifriction amount of a polyhydroxy hydrocarbylamine of the formula $$(HO)_xRN(R^1)_2$$

wherein R is a $C_2$ to $C_6$ hydrocarbyl group, $R^1$ is hydrogen or a $C_{10}$ to $C_{30}$ hydrocarbyl group, at least one of $R^1$ being a hydrocarbyl group and x is 2 or 3.

2. The composition of claim 1 wherein the amine is derived from decylamine, dodecylamine, tetradecylamine, octadecylamine, oleylamine, soyamine, tallowamine, and mixtures of such amines.

3. The composition of claim 1 wherein the amine is 1,2-dihydroxy cocoamine.

4. The composition of claim 1 wherein the amine is 1,2-dihydroxy octadecylamine.

5. The composition of claim 1 wherein the lubricant is a mineral oil.

6. The composition of claim 1 wherein the lubricant is a synthetic oil.

7. The composition of claim 1 wherein the lubricant is a mixture of synthetic oils.

8. The composition of claim 1 wherein the lubricant is mixture of mineral and synthetic oils.

9. The composition of claim 1 wherein the lubricant is a grease according to (4).

10. A method of reducing fuel consumption in an internal combustion engine by lubricating said engine with a composition comprising a major proportion of a lubricating oil selected from the group consisting of (1) a mineral oil, (2) a synthetic oil, (3) a mixture of synthetic oils, (4) a mixture of a mineral oil and a synthetic oil and (5) a grease of (1), (2), (3) or (4) and a fuel reducing amount of an amine of the formula $$(HO)_xRN(R^1)_2$$

wherein R is a $C_2$ to $C_6$ hydrocarbyl group, $R^1$ is hydrogen or a $C_{10}$ to $C_{30}$ hydrocarbyl group, at least one of $R^1$ being a hydrocarbyl group and x is 2 or 3.

11. The method of claim 10 wherein the amine is derived from decylamine, dodecylamine, tetradecylamine, octadecylamine, oleylamine, soyamine, tallowamine, and mixtures of such amines.

12. The method of claim 10 wherein the amine is 1,2-dihydroxy octadecylamine.

13. The method of claim 10 wherein the amine is 1,2-dihydroxy cocoamine.

14. The method of claim 10 wherein the lubricant is a mineral oil.

15. The method of claim 10 wherein the lubricant is a synthetic oil.

16. The method of claim 10 wherein the lubricant is a mixture of synthetic oils.

17. The method of claim 10 wherein the lubricant is a mixture of mineral and synthetic oils.

* * * * *

UNITED STATES PATENT AND TRADEMARK OFFICE

CERTIFICATE OF CORRECTION

PATENT NO. : 4,545,915

DATED : October 8, 1985

INVENTOR(S) : Andrew G. HORODYSKY et al

It is certified that error appears in the above-identified patent and that said Letters Patent is hereby corrected as shown below:

Column 1, between line 63 and line 64, please insert the following paragraph:

--The useful amines can be synthesized using several methods known to the art. For example, an alkylamine -1,2-propanediol, represented as $$R^1NH - CH_2 - \underset{OH}{\underset{|}{CH}} - \underset{OH}{\underset{|}{CH_2}}$$

can be prepared by the reaction of the appropriate alkylamine or sodium alkylamide with 1-chloro-2,3-propanediol, or more preferably by the reaction of the alkylamine with glycidol at room temperature, to wit:

$$R^1NH_2 + CH_2(OH)\underset{O}{CH \text{----} CH_2} \quad \text{toluene} \quad \underset{A}{RNHCH_2 - \underset{OH}{\underset{|}{CH}} - \underset{OH}{\underset{|}{CH_2}}} + \underset{B}{RNHCH(CH_2OH)_2}\text{--.}$$

Column 4, line 60 (claim 8, line 1), after "is" insert --a--.

Signed and Sealed this

Third Day of June 1986

[SEAL]

Attest:

DONALD J. QUIGG

Attesting Officer

Commissioner of Patents and Trademarks